US005917694A

United States Patent [19]

Denny

[11] Patent Number: 5,917,694

[45] Date of Patent: Jun. 29, 1999

[54] APPLIANCE ORGANIZER

[76] Inventor: Brian D. Denny, 2056 Huntington Cir., Fort Collins, Colo. 80526

[21] Appl. No.: 09/030,932

[22] Filed: Feb. 26, 1998

Related U.S. Application Data

[60] Provisional application No. 60/036,673, Mar. 11, 1997.

[51] Int. Cl.[6] ..... H02B 1/18; H05K 7/20

[52] U.S. Cl. ..... 361/643; 206/372; 211/70.6; 211/87; 248/314; 361/690; 439/501; 439/577

[58] Field of Search ..... 206/372; 211/70.6, 211/87; 248/314; 361/600, 643, 679, 689, 690; 439/501, 577

[56] References Cited

U.S. PATENT DOCUMENTS

| | | | |
|---|---|---|---|
| 2,585,758 | 6/1952 | Fjermestad . | |
| 3,786,312 | 1/1974 | Roussard | 361/643 |
| 4,159,773 | 7/1979 | Losenno . | |
| 4,219,178 | 8/1980 | Assion . | |
| 4,875,878 | 10/1989 | Meyer . | |
| 5,318,356 | 6/1994 | Shelton . | |
| 5,344,339 | 9/1994 | Cheslock . | |
| 5,472,157 | 12/1995 | Lehrman . | |
| 5,485,931 | 1/1996 | Barr, Jr. . | |

*Primary Examiner*—Gregory Thompson
*Attorney, Agent, or Firm*—Richard C. Litman

[57] ABSTRACT

An organizer device for hair care appliances including a housing and a plurality of receptacles therein which are adapted to receive hair dryers, hair curlers, and other hair care appliances. The receptacles are exposed from one or more surfaces of the housing and they are formed of an insulative material which allows them to decrease the initial heat-up time for curling irons by minimizing the effects of convection and conduction. The housing is provided with a number of electrical outlets and a main power switch, all of which are disposed on the front of the housing in an accessible position. A main electrical cord connects the electrical receptacles on the housing to a wall socket. Accordingly, it is a principal object of the invention to provide a appliance organizer that combines a plurality of terminal receptacles with a main power switch, a plurality of cylindrical tubes adapted for receiving a hair dryer and a plurality of curling irons, and a main power cord.

4 Claims, 4 Drawing Sheets

APPLIANCE ORGANIZER

CROSS-REFERENCE TO RELATED APPLICATION

This application claims the benefit of U.S. Provisional Patent Application Ser. No. 60/036,673, filed Mar. 11, 1997.

BACKGROUND OF THE INVENTION

1. Field of the Invention

The present invention relates to appliance holders and more specifically to an organizer device useful in connection with various hair care appliances.

2. Description of Relevant Art

Implements used to style hair are as varied and numerous as the holding devices for storing and organizing them. The general need to hold, store, and organize electric appliances is widely recognized as reflected by the numerous references within the related art.

Providing a terminal box as an integral part of an appliance holding device is disclosed in U.S. Pat. No. 2,585,758, issued to Odd Fjermestad on Feb. 12, 1952. U.S. Pat. No. 4,159,773, issued to Luigi G. Losenno on Jul. 3, 1979, discloses a beautician's tool hanger for holding and thermally insulating curling irons and a hot comb. U.S. Pat. No. 4,219,178, issued to Norbert Assion discloses a storage or holder device for an electrical appliance such as a hair dryer. U.S. Pat. No. 4,875,878, issued to Robert R. Meyer on Oct. 24, 1989, discloses an extension cord/tool carrier with a terminal strip. Examples of terminal receptacle and article holder combinations are shown in U.S. Pat. No. 5,318,356, issued to J. Calvin Shelton on Jun. 7, 1994, and U.S. Pat. No. 5,472,157, issued to David Lehrman. U.S. Pat. No. 5,344,339, discloses a portable tool caddie with a retractable power cord assembly having four power outlets. U.S. Pat. No. 5,485,931, issued to John F. Barr, Jr., on Jan. 23, 1996, discloses a hair dryer caddie with bores designed to releasably receive the handle portion of hair drying or shaping implements.

None of the prior art devices show the combination of a plurality of terminal receptacles with a main power switch, a power cord, and a plurality of receptacles adapted to receive a hair dryer and a plurality of curling irons.

None of the above inventions and patents, taken either singly or in combination, is seen to describe the instant invention as claimed.

SUMARY OF THE INVENTION

The present invention is an organizer device for hair care appliances adapted to be placed on a planar horizontal surface or attached to a wall. The device includes a housing and a plurality of receptacles therein which are adapted to receive hair dryers, hair curlers, and other hair care appliances. The receptacles have mouths for receiving appliances which mouths are defined by a top planar surface of the housing. Each receptacle functions to decrease the initial heat-up time for curling irons by minimizing the effects of convection and conduction. To minimize the effects of convection and conduction, the receptacles are formed of an insulative material and are configured to surround the heated barrel of the curling irons to prevent their exposure to the ambient air.

In contrast, the receptacle adapted to receive a hair dryer includes an additional opening through a planar base, effectively forming a tube, to aid in cooling the hair dryer through the effects of convection and conduction. The housing is provided with a number of electrical outlets and a main power switch, all of which are disposed on the front of the housing in an accessible position. A main electrical cord connects the electrical receptacles on the housing to a wall socket.

Accordingly, it is a principal object of the invention to provide an appliance organizer that combines a plurality of terminal receptacles with a main power switch, a plurality of tubes adapted for receiving a hair dryer and a plurality of curling irons, and a power cord.

It is another object of the invention to provide a plurality of tubes for holding curling irons that aid in the initial heating and maintenance of heat within a curling iron.

It is a further object of the invention to provide an appliance organizer that is available in a variety of decorative finishes intended to match the furnishings or fixtures within the area of intended use.

Still another object of the invention is to provide integral mounting holes within the back wall of the appliance organizer for ease of wall mounting installation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
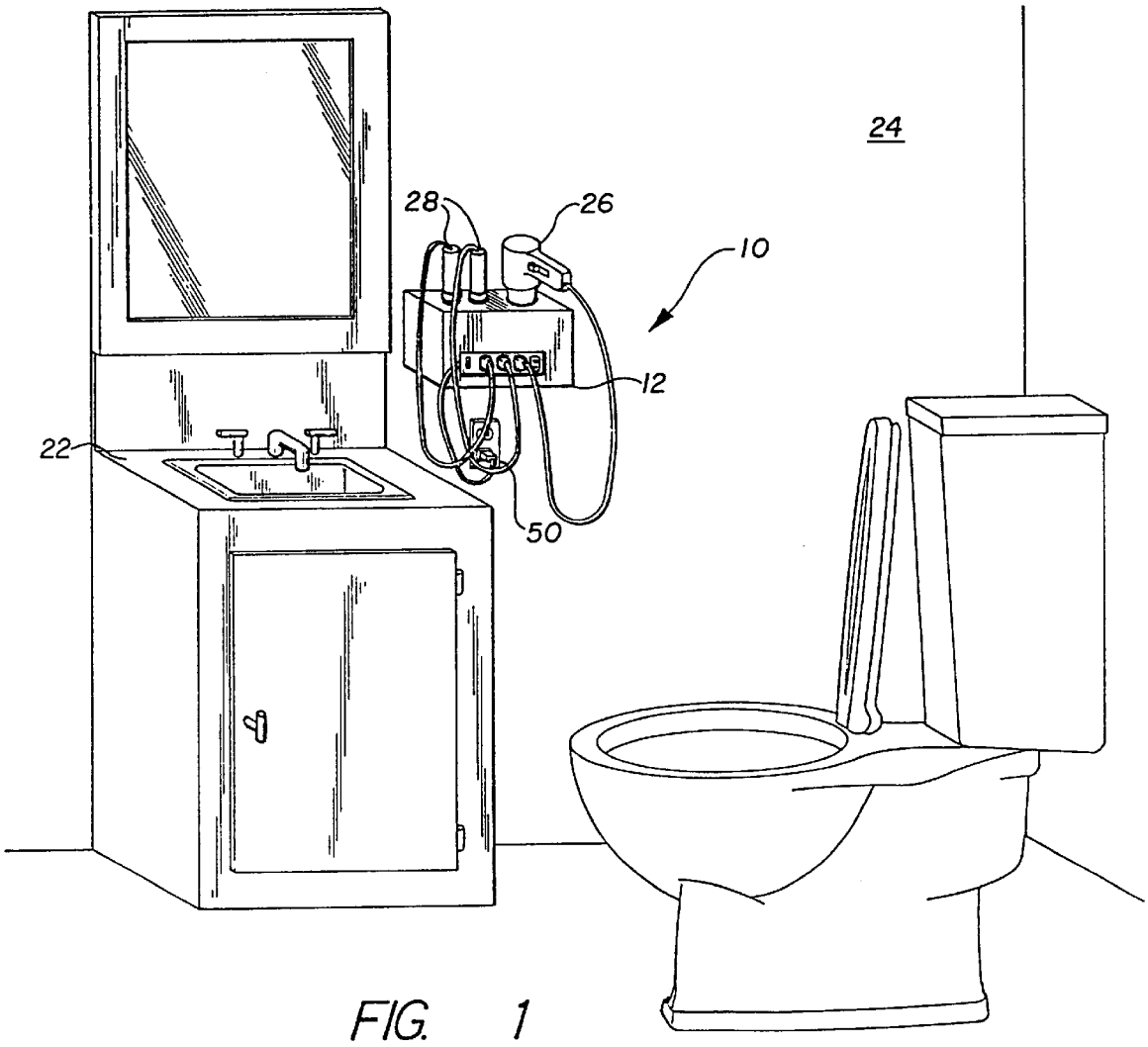
FIG. 1 is an environmental perspective view of the appliance organizer according to the present invention.
Figure 2:
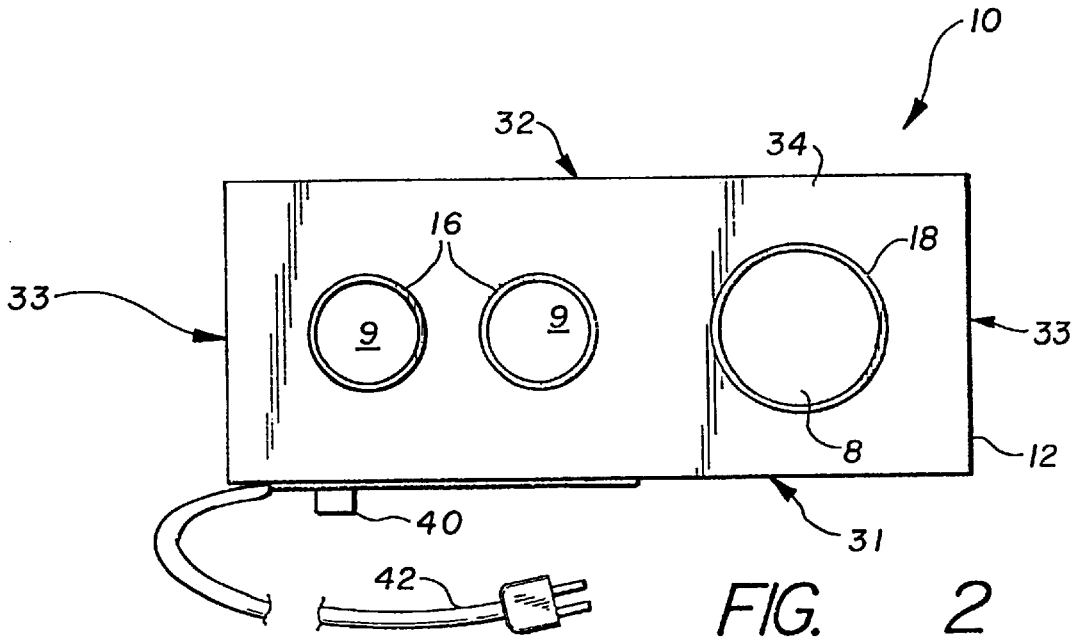
FIG. 2 is a top plan view of the appliance organizer according to the present invention.
Figure 3:
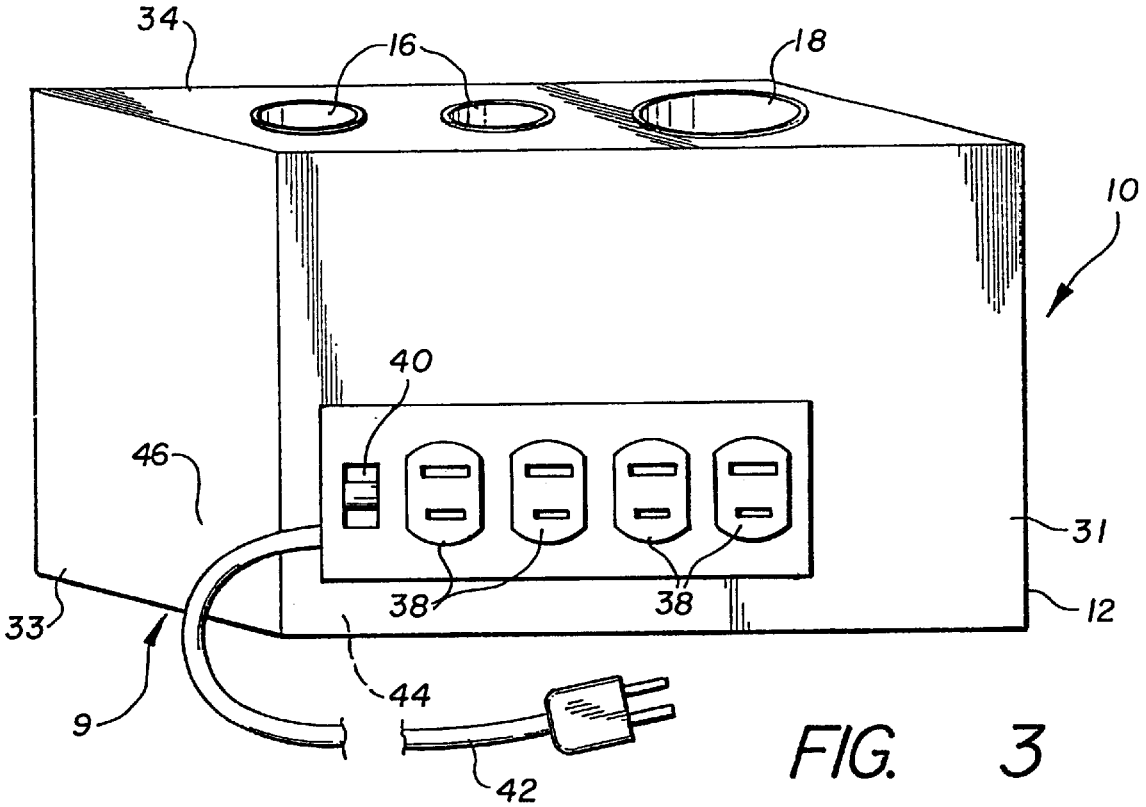
FIG. 3 is a front perspective view of the appliance organizer according to the present invention.
Figure 4:
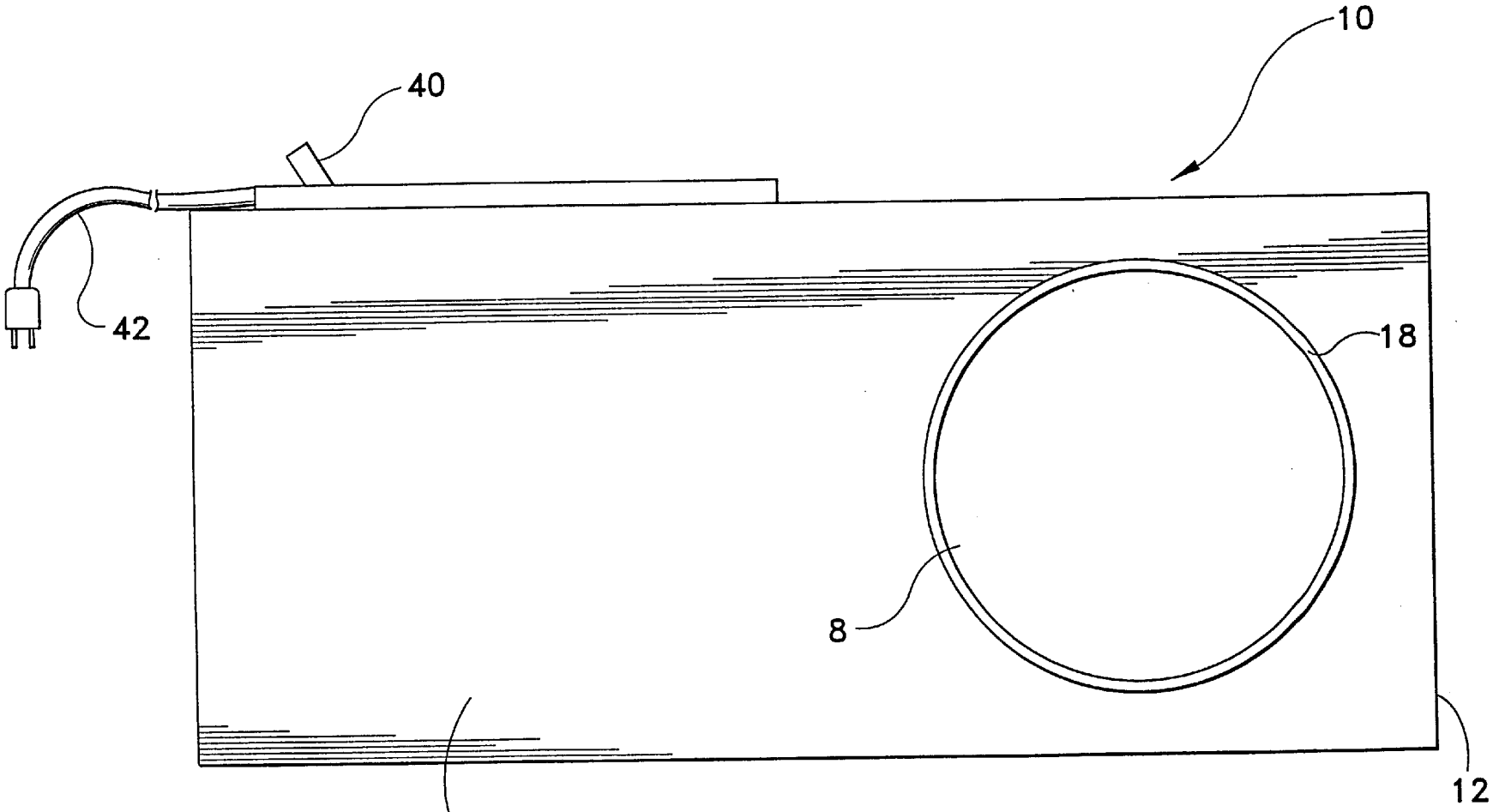
FIG. 4 is a bottom plan view of the appliance organizer according to the present invention.

Referring to FIGS. 1–4, the present invention is an organizer device 10 for hair care appliances (i.e., hair dryers 26, hair curlers 28, etc.) which may be adapted to be placed on a planar horizontal surface 22 or attached to a wall 24. The device 10 comprises a housing 12 which may have any shape or configuration. As shown in the accompanying figures, the housing 12 has a box-like configuration which has a planar base 9 which lends itself to placement upon a horizontal surface 22 (i.e., countertop, vanity, etc.) or mounting upon a wall 24.

The housing 12, with its box-like configuration, includes a substantially planar base 9 having an opening 8, a front 31, a substantially planar back 32, end-walls 33, and a top 34. The top 34 is provided with a plurality of openings which receive variously sized and shaped receptacles 16 and 18. Each of receptacles 16 and 18 have a mouth exposed through the top 34, each receptacle therefore aligned in a substantially vertical orientation. Receptacle 18, adapted to receive a hair dryer 26, includes a second opening 8 through the substantially planar base 9 and thereby forms an open ended tube through the housing. The tubular nature permits air flow to the hair dryer nozzle for cooling thereof. Moreover, the second open end permits temporary positioning within receptacle 18 of the hair dryer while on and blowing air, thereby permitting the airstream to escape, and preventing an excessive build up of heat which might damage the hair dryer or the receptacle.

However, it should be apparent to one skilled in the art that the appliance receiving receptacle openings need not be limited to the top surface, but may also be exposed through any side of the housing 12 with the receptacles oriented in any substantially upright position. Although not shown, the receptacles may be exposed through the top or a sidewall with an angular alignment which angularly displaces the handle of any hair care appliance placed therein.

Each of the receptacles preferably is formed with a length of poly(vinyl chloride) tubing (PVC tubing) of predetermined configuration which is inserted through an opening in the top 34 of the housing 12. The PVC tubing serves as an insulator to accelerate heating of the curling iron barrel and maintain its temperature during non-use by minimizing the effects of conduction and convection. Other insulative materials may be used in forming the receptacles, including various polymers such as the material from which the housing of the hair dryer itself is formed, various metals having a relatively low thermal conductivity such as stainless steel or iron, or other insulating materials having low thermal conductivity, low flammability, and which are not easily deformed in the presence of heat. As noted, the receptacle 18 is exposed through an opening 8 in the substantially planar base 9 to allow cooling of the hair dryer heating element during non-use via the effects of conduction and convection.

On the front 31 is a main power switch 40 and a plurality of electrical outlets 38 which are disposed to receive the cords of the electrical hair care appliances. In the first embodiment of FIGS. 1–4, a conventional multi-outlet power strip is shown; in FIG. 5, a conventional square outlet box is shown. Although not shown but as may be included by one of ordinary skill in the electrical arts, additional separate switches may also be provided to control the supply of electrical current to any one of the plurality of specific electrical outlets 38 shown in the Figures. The additional switches would provide a means for controlling the electrical supply to one hair care appliance of a type which do not have an on/off switch. This would allow such a hair care appliance to remain plugged in to a set of energized, electrical outlets 38 without having the appliance heat up when a user does not intend to utilize the appliance while using other appliances.

The device 10 may be removably mounted upon a wall 24 with the use of conventional wall anchors and slots provided in the back 32, or any other conventional brackets, braces, or other mounting means. In the preferred embodiment, the device 10 is equipped with a standard main power cord 42.

Figure 5:
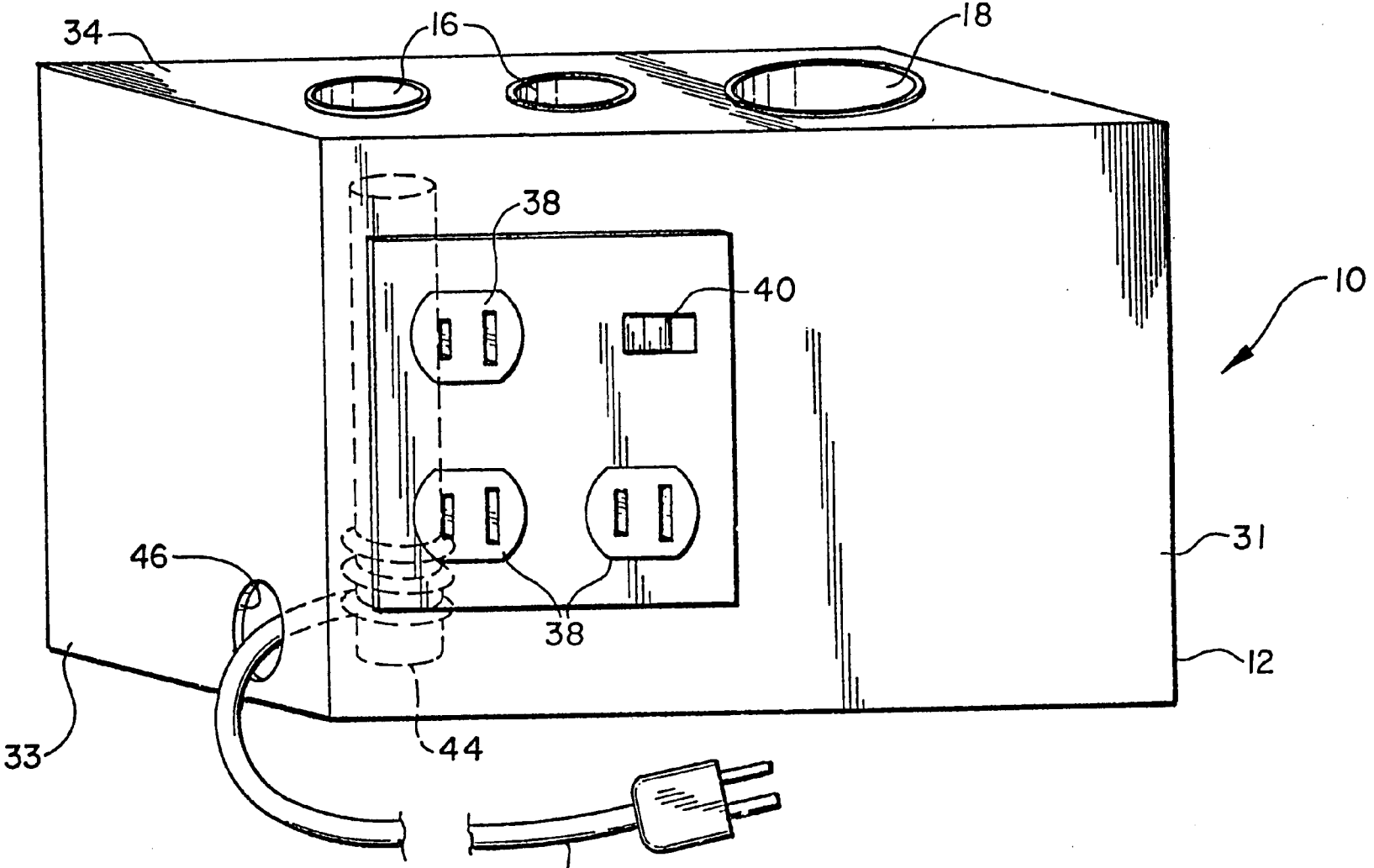
FIG. 5 is a front perspective view of an alternative embodiment of the appliance organizer with a retracting main power cord according to the present invention.

In another embodiment, as shown in FIG. 5, the device 10 may be equipped with a retractable power cord by mounting any conventional means for retracting a power cord 42, for example, a spring-biased take-up reel 44 of conventional design, internal of the housing 12, in order to take up any of the excess power cord 42 through an opening 46 in the housing 12.

It is to be understood that the present invention is not limited to the sole embodiment described above, but encompasses any and all embodiments within the scope of the following claims.

I claim:

1. An appliance organizer comprising:

a housing including a substantially planar base and a plurality of receptacles each defining a mouth opening in said housing;

an electrical outlet mounted to said housing;

a main power switch connected to said electrical outlet for regulating the supply of electrical current to said outlet;

a main power cord connected to said power switch for supplying electrical current from a wall outlet; and wherein at least one said receptacle in said housing is dimensioned and configured to receive a hand-held electrical appliance, said receptacle defining a second opening in the planar base of said housing, whereby said receptacle is open to ambient air flow between and through the mouth and second opening.

2. The appliance organizer according to claim 1, further comprising a retracting means disposed in said housing for retracting said main power cord.

3. The appliance organizer according to claim 1, wherein at least one said receptacle is constructed of an insulative material.

4. The appliance organizer according to claim 1, wherein said at least one receptacle is constructed of poly(vinyl chloride).

* * * * *